US005110702A

United States Patent [19]

Ng et al.

[11] Patent Number: 5,110,702

[45] Date of Patent: May 5, 1992

[54] PROCESS FOR TONED IMAGE TRANSFER USING A ROLLER

[75] Inventors: Yee S. Ng, Fairport; Donald S. Rimai, Webster, both of N.Y.

[73] Assignee: Eastman Kodak Company, Rochester, N.Y.

[21] Appl. No.: 612,948

[22] Filed: Nov. 13, 1990

Related U.S. Application Data

[63] Continuation-in-part of Ser. No. 448,487, Dec. 11, 1989, abandoned.

[51] Int. Cl.[5] ..... G03G 13/16

[52] U.S. Cl. ..... 430/99; 430/126; 427/14.1

[58] Field of Search ..... 430/99, 126; 427/14.1; 118/60, 202, 641

[56] References Cited

U.S. PATENT DOCUMENTS 3,591,276 7/1971 Byrne ..... 101/130 X
3,669,706 6/1972 Sanders et al. ..... 118/202 X
3,698,314 10/1972 Grier ..... 101/426
4,430,412 2/1984 Miwa et al. ..... 430/126
4,439,462 3/1984 Tarumi et al. ..... 427/14.1
4,853,737 8/1989 Hartley et al. ..... 355/289
4,927,727 5/1990 Rimai et al. ..... 430/99

FOREIGN PATENT DOCUMENTS 57-16326 4/1982 Japan .

*Primary Examiner*—Evan Lawrence
*Attorney, Agent, or Firm*—Dressler, Goldsmith, Shore, Sutker & Milnamow

[57] ABSTRACT

A process is provided for the non-electrostatic transfer of a toned image. Using an intermediate transfer roll from an element to a receiver, a developed toned image on the surface of an element is transferred by pressure and heat to a transfer roll. The heat is sufficient to sinter the toner particles to each other. The roll is then positioned against a receiver and rolled thereover and the toned image is transferred to the receiver. If the combination of heat and pressure is sufficient, the transferred toned image is fused to the receiver during the transfer; if not, then the transferred image can be subsequently fused to the receiver. The process is suited for producing high resolution images from very small particle size toner powder on rough paper.

10 Claims, 3 Drawing Sheets

PROCESS FOR TONED IMAGE TRANSFER USING A ROLLER

CROSS REFERENCE TO RELATED APPLICATION

This invention is a continuation-in-part of U.S. patent application Ser. No. 07/448,487, filed Dec. 11, 1989 entitled "TONED IMAGE TRANSFER USING A ROLLER", now abandoned.

FIELD OF THE INVENTION

This invention is in the field of dry, nonelectrostatic toner transfer procedures involving roller usage to accomplish an intermediate and then a final transfer of a toned image from a photoconductor element to a receiver.

BACKGROUND OF THE INVENTION

In electrostatic copying, an electrostatic latent image is formed on the surface of a photoconductor element which is developed into a visible image by the application of toner powder thereover. The resulting toned image is then transferred by electrostatic means from the element to the surface of a receiver sheet to which the transferred toned image is fused with the aid of heat and/or pressure.

In a modification of this procedure, the toned image is transferred to the surface of an intermediate transfer medium in the form of an endless belt or roll, and, from such transfer medium, the toned image is further transferred to a receiver sheet to which the toned image is fused. In U.S. Pat. No. 4,439,462, for example, the transfer medium bearing the toned image is heated to a temperature at which the toner remains in a nonfluid condition while the receiver sheet is heated to a temperature substantially greater than the toner melting temperature, and then the transfer medium and receiver are brought into pressurized contact to effect transfer and fusion of the toned image to the receiver sheet.

In U.S. Pat. No. 3,698,314, a receiver sheet is positioned over a heated transfer roll, and the resulting assembly is rolled over the toned image bearing surface of an element. The heat gradient is sufficient to transfer the toned image from the element to the receiver sheet.

In Japanese Patent Application No. 047,266 (57163264), a toned image is transferred to an endless belt intermediate transfer material by pressure, and the belt and transferred toned image thereon are heated and then pressed against a preheated receiver sheet to effect toned image transfer to the receiver. Thereafter, the toned image is fused.

So far as now known, no one has first transferred a toned image to an intermediate transfer roll while sintering the toner powder and then transferring the image to a receiver.

SUMMARY OF THE INVENTION

A process is provided for transferring a toner powder image from an element to a receiver using an intervening transfer roller.

The process is particularly suitable for transfer of high resolution toner powder images comprised of very small sized toner particles from an element to a relatively stiff paper sheet. The toned image on the receiver can be heat fused thereto either at, or subsequent to, the time of transfer thereto.

The process of the present invention can be utilized in conventional transfer processes or in a thermally assisted transfer process such as that disclosed in U.S. Pat. No. 4,927,727, the teachings of which are incorporated by reference.

The intermediate roller transfer technique of the present invention offers ease in handling, and is less subject to adverse variations than conventional image transfer techniques. Copied images having little or even no loss in image resolution can be achieved by the present technique.

The process of the present invention can also be used in a three or four color transfer procedure wherein the transfer of three or four toned images, each having a different color, onto roller surfaces is accomplished before the composite colored image is transferred to a receiver, such as paper or the like.

More particularly, in the practice of this invention, a transferrable toner powder image is first formed on the surface of an element by known electrostatic latent image formation techniques followed by known toner powder development techniques. Then, in accordance with the present invention, the toner powder image is transferred to heated surface portions of a roller or web that is moved with applied pressure over the surface of the element having the toner powder image thereon. The toner particles that comprise the developed toned image are sintered and transferred to the roller or web. The heated roller bearing the transferred image is then moved with applied pressure over a heated surface of a receiver. Under the conditions chosen, the sintered toner powder is transferred from the roller to the receiver.

The combination of heat and pressure employed for the transfer from roller to receiver can either be (a) sufficient to effect a transfer of toned image from the roller to the receiver with some further sintering of toner particles, or (b) sufficient to accomplish the transfer and also effect a fusion of the toner particles to the receiver. If route (a) is used, then the transferred sintered image on the receiver is fused to the receiver in a separate step using heat and/or pressure.

Accordingly, the present invention provides a two-step toned image transfer technique using heat and pressure from element to receiver. The technique is particularly useful for making copies having high image resolution, and also registration in the case of colored copies, using very small sized toner particles.

The technique of this invention can be used with a wide variety of receivers, including relatively stiff paper and thermoplastic polymer coated paper.

Other and further aims, features, advantages and the like will be apparent to those skilled in the art when taken with the appended drawings and claims.

DETAILED DESCRIPTION OF THE INVENTION

(a) Definitions

Figure 1:
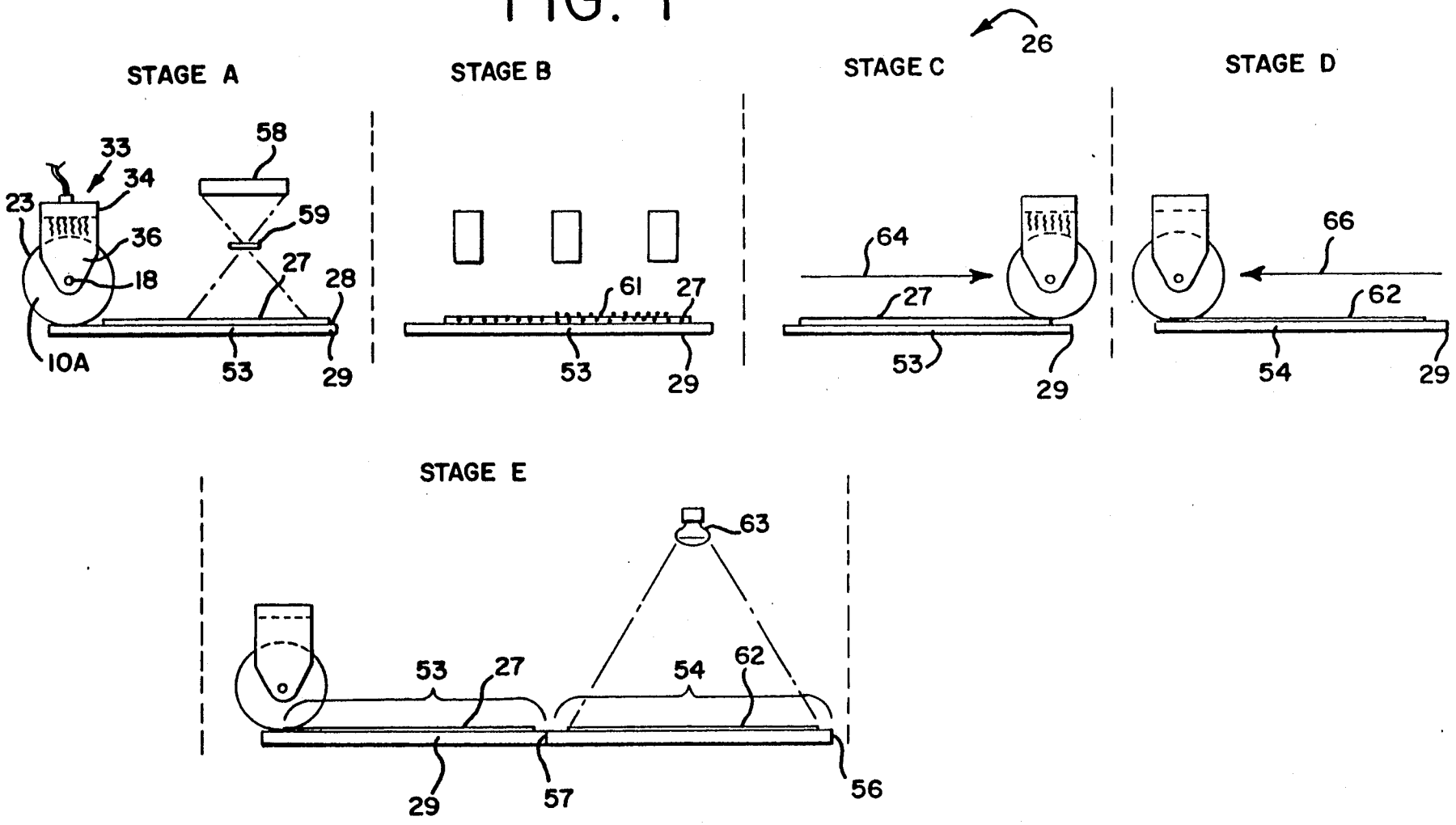
FIG. 1 is a diagrammatic representation of one embodiment of copying apparatus suitable for use in the practice of the invention, such apparatus being illustrated in five successive stages of operation.

The term "particle size", or the term "size, or "sized" as employed herein in reference to the term "particles", means volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or "$T_g$" as used herein means the temperature at which an amorphous material changes from a glassy state to a liquid state. This temperature ($T_g$) can be measured by differential thermal analysis as disclosed in Mott, N. F. and Davis, E. A., *Electronic Processes in Non-Crystalline Material*, Oxford Univ. Press., Belfast (1971).

The term "melting temperature" or "$T_m$" as used herein means the temperature at which a crystalline material changes from a solid state to a liquid state. This temperature ($T_m$) can be measured by differential thermal analysis as disclosed in *Electronic Processes in Non-Crystalline Material.*

The term "sintering temperature" as used herein means the temperature at which toner particles bond together or fuse together at locations of contact existing either between adjacent toner particles or between toner particles and an adjacent surface.

The term "fusion temperature" or "fusing temperature" as used herein means the temperature at which toner particles tend to lose their discrete individual identities and melt or blend together into a localized mass which bonds to an adjacent surface, such as the surface of a receiver.

The term "sinters" or "sintering" as used herein in relation to toner particles employed in the practice of this invention, thus has reference to bonding or fusion that is thermally achieved at locations of contact existing either between adjacent toner particles or between toner particles and an adjacent surface. The term "sinter" and equivalent forms is distinguished from present purposes from a term such as "melts", "melting", "melt", "melt fusion" or "heat fusion". In heat fusion, in response to sufficient applied thermal energy, toner particles tend to lose their discrete individual identities to melt, and to blend together into a localized mass, as when a toner powder is heat fused and thereby bonded or fixed to a receiver.

The term "surface tension" or "surface energy" as used herein means the energy absorbed by the system in creating a surface between the bulk of the material and a vacuum. Surface tension or surface energy for materials comprising films, toner powders, and the like can be measured by the contact angle procedure disclosed in Rev. Mod. Phys. 57, 827–863 (1985).

The term "element" as used herein has reference to any of the known electrostratographic elements, including photoconductor elements, graphic elements, dielectric recording elements, and like electrophotographic elements. Examples of such elements can be found in, for instance, U.S. Pat. Nos. 4,175,960 and 3,615,414.

The term "receiver" as used herein has reference to a substrate upon which a toner powder image can be formed by deposition and fused such as, for example, by the application of heat or by other methods of permanently fixing. Examples of suitable receivers include paper, plastic film, such as films of polyethylene terephthalate, polycarbonate, or the like, which are preferably transparent and therefore useful in taking transparencies and thermoplastic polymer coated receivers which comprise at least one layer or coating of a thermoplastic polymer on a suitable support. In those instances where a thermoplastic polymer coated receiver is utilized, almost any type of support can be used to make the coated receiver used in this invention, including paper, film, and particularly transparent film, which as previously mentioned, is useful in making transparencies. The support must not melt, soften, or otherwise lose its mechanical integrity during transfer, sintering or heat fusion of toner particles as taught herein. A good support should not absorb the thermoplastic polymer, but should permit the thermoplastic polymer to stay on its surface and form a good bond to the surface. Supports having smooth surfaces will, of course, result in a better image quality. A flexible support is particularly desirable, or even necessary in many copy machines. A support is required in this invention when a thermoplastic polymer coated receiver is utilized because the thermoplastic coating must soften during transfer and fixing of the toner particles to the receiver, and without a support the thermoplastic coating would warp or otherwise distort, or form droplets, destroying the image. In a conventional thermal transfer process, preferred receivers do not readily absorb the thermoplastic polymer matrix of the toner particles when such toner particles are being heat fused, so that such polymer tends to stay on the surface portions of a substrate and to form a good bond thereto. In a thermally assisted transfer process, the receiver can be a thermoplastic polymer coating on a support as described above. The support can be paper, a plastic film, a metallic film, or the like. Paper is the preferred support. The thermoplastic can be any of a variety of condensation or addition polymers or blends thereof such as polyesters, polystyrene and styrene butyl acrylates. These materials should have a $T_6$ between about 40° and 80° C. and have surface energies between about 35 and 50 dynes/cm. If a thermoplastic receiver is used, the $T_g$ of the toner should be less than about 10° C. above that of the thermoplastic. The thermoplastic polymer must be sufficiently adherent to the support so that it will not peel off when the receiver is heated. It must also be sufficiently adherent to the toner so that transfer of the toner occurs. The thermoplastic coating should also be abrasion resistant and flexible enough that it will not crack when the receiver is bent. A good thermoplastic polymer should not shrink or expand very much, so that it does not warp the receiver or distort the image. Substrates having a smooth surface will tend to result in a better quality heat fused image. Paper supports are presently preferred.

The term "locations of contact" as used herein in relation to toner particles employed in the practice of this invention and to surfaces contacted thereby has reference to localized regions or points on individual toner particle surfaces which are in contact either with one another, or with the surface upon which such a particle is deposited.

The term "hardness" as used herein has reference to the resistance of a metal or other material to indentation, scratching, abrasion, or cutting.

(b) Starting Materials

Toner particles employed in the practice of this invention can be conventionally prepared. Broadly, suitable toners can have a particle size in the range of about 1 to about 20 microns. In the practice of this invention where very small particle size toner powders are used, they can have a size in the range of about 3 to about 15 microns, and preferably in the range of about 3 to about 6 microns.

Toner particles used in the practice of this invention typically comprise a thermoplastic matrix polymer which has dispersed therein a charge control agent and a colorant (i.e., a dye or a pigment) in respective amounts such as are conventionally used in the prior art. Thus, preferably and typically, such particles comprise about 78 to about 98 weight percent of matrix polymer, about 0.2 to about 2 weight percent of charge control agent, and about 2 to about 20 weight percent of colorant.

Such a thermoplastic matrix polymer in toner particles used in the practice of this invention preferably has a glass transition temperature in the range of about 50° to about 120° C., preferably about 60° to about 100° C., although they can have somewhat lower and somewhat higher $T_g$'s. Preferably also, such a thermoplastic polymer has a melting point ($T_m$) that is in the range of about 65° to about 200° C., although such polymers can have somewhat lower and somewhat higher $T_m$'s. Presently more preferred are thermoplastic polymers having a melting point ($T_m$) in the range of about 65° to 120° C.

Preferably, the particle size distribution for a given group of toner particles is narrow. For example, a size distribution or deviation in the range of about ±1 micron from a mean particle size is preferred, although larger and smaller such deviations can be employed. Particularly when such very small particle size toner powders are being used, it is desirable to have a narrow particle size distribution.

Preferably toner particles have relatively high caking temperatures, such as caking temperatures above about 60° C., so that they can be stored with little or no agglomeration or caking.

Matrix polymers for use in toner particles which have such properties can be chosen from among polymers heretofore employed in toner powders, such as polyesters; polymers of acrylic and/or methacrylic acid, including poly(alkylacrylates), poly(alkylmethacrylates), and the like, wherein the alkyl moiety contains 1 to about 10 carbon atoms; styrene containing polymers, including copolymers and blends thereof; and the like.

For example, matrix polymers can comprise a polymerized blend containing, on a 100 weight percent combined weight basis, about 40 to about 100 weight percent of styrene, about 0 to about 45 weight percent of a lower alkyl acrylate or methacrylate having 1 to about 6 carbon atoms in the alkyl moiety, such as methyl, ethyl, isopropyl, butyl, etc., and about 5 to about 50 weight percent of a vinyl monomer other than styrene, such as, for example, a higher alkyl acrylate or methacrylate having about 6 to about 20 or even more carbon atoms in the alkyl moiety. Typical styrenecontaining polymers prepared from such a copolymerized blend as above indicated are copolymers prepared from a monomeric blend that comprises on a 100 weight percent basis about 40 to about 60 weight percent styrene or styrene homolog, about 20 to about 50 weight percent of a lower alkyl acrylate or methacrylate, and about 5 to about 30 weight percent of a higher alkyl acrylate or methacrylate, such as ethylhexyl acrylate (e.g., styrene-butylacrylate-ethylhexylacrylate copolymer, or the like). Preferred styrene copolymers are those that are covalently cross-linked with a small amount of a divinyl compound, such as divinylbenzene. A variety of other useful styrene-containing toner polymer materials are disclosed in U.S. Pat. Nos. 2,917,460; 2,788,288; 2,638,416; 2,618,552; and 2,659,670; and U.S. Reissue Pat. No. 25,316.

Those skilled in the art will appreciate that various additives, such as colorants, charge control agents, surfactants, and the like, as known to the art, can be incorporated into the toner particles in conventional quantities.

Toner particles used in the practice of this invention can be prepared, for example, by any convenient technique, including compounding and grinding, suspension polymerization, limited coalescence, and the like.

In a conventional thermal transfer process, the toner particles have a fusion temperature in the range of about 70° to about 170° C. and preferably in the range of about 90° to about 145° C. In a thermally assisted transfer process, the toner particles generally have a fusing temperature in the range of about 70° to about 120° C.

The elements employed in the practice of this invention are known to the art, as are methods for their preparation. Typically, a release agent is applied to the surface of the element or is incorporated into the element to enhance toner release from the element to the intermediate. It is also frequently desirable to treat the intermediate with a release agent.

One presently preferred class of reusable electrophotographic imaging elements suitable for use in the practice of this invention is taught in U.S. Pat. No. 4,047,175, the teachings of which are incorporated hereto by reference.

In general, the sintering temperature of the toner particles used in the practice of this invention should be below the glass transition temperature of the polymer comprising the surface composition of the element upon which a toner image is formed. Preferably the sintering temperature is below the glass transition temperature of all layers of polymer employed in the element and also is below the decomposition temperature of all materials contained in an element employed in the practice of this invention.

As a matter of convenience, it is presently preferred that the element employed in an embodiment of this invention be capable of being conventionally imaged so that, for example, a graphic image, an image of alphanumeric characters, an image originating from a light emitting diode (LED), or the like can be formed upon a surface of the element and thereby produce a latent electrostatic image which is capable of development into a visible image comprised of toner powder by a conventional deposition procedure.

(c) Equipment

Two apparatus embodiments suitable for the practice of the invention are provided herewith, each of which preferably employs a photoconductor element.

In one apparatus embodiment 26, shown in FIG. 1, a photoconductor element 27 is employed that is in a sheet form and has a generally square or rectangular perimeter configuration. The element 27 is positioned on the flat surface 28 of a platen 29.

Figure 3:
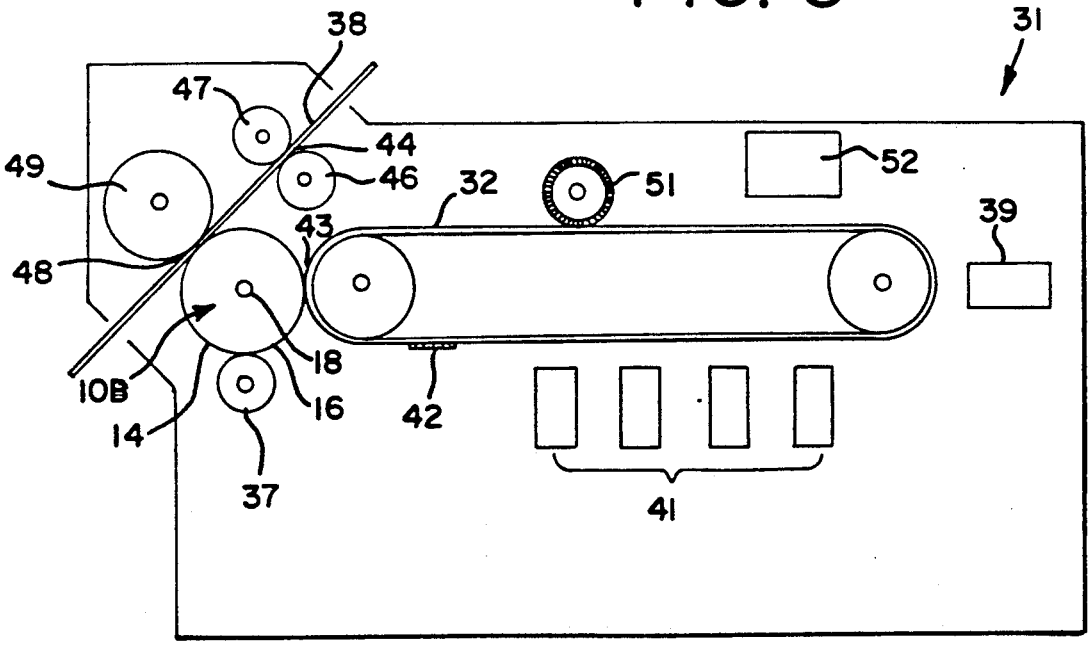
FIG. 3 is a diagrammatic vertical sectional illustration of another embodiment of copying apparatus suitable for use in the practice of this invention.

In a second apparatus embodiment 31 of the invention shown in FIG. 3, a photoconductor element 32 is employed that is in the physical form of an endless belt. The element or belt 32 can be made by any convenient procedure. For example, a photoconductor element in sheet form that is comprised of successive layers comprising, a supporting layer, an electrically conductive layer, a charge generation layer, and a charge control layer, can be applied to a preformed belt, such as a belt of woven heavy fabric that is impregnated with an elastomeric, polymeric composition, or the like, as desired.

The intermediate transfer roller employed in the practice of this invention need have no special construction. It is preferred that the present invention be practiced with conventional roller assemblies which are internally heated by electrical means, or the like.

Figure 2:
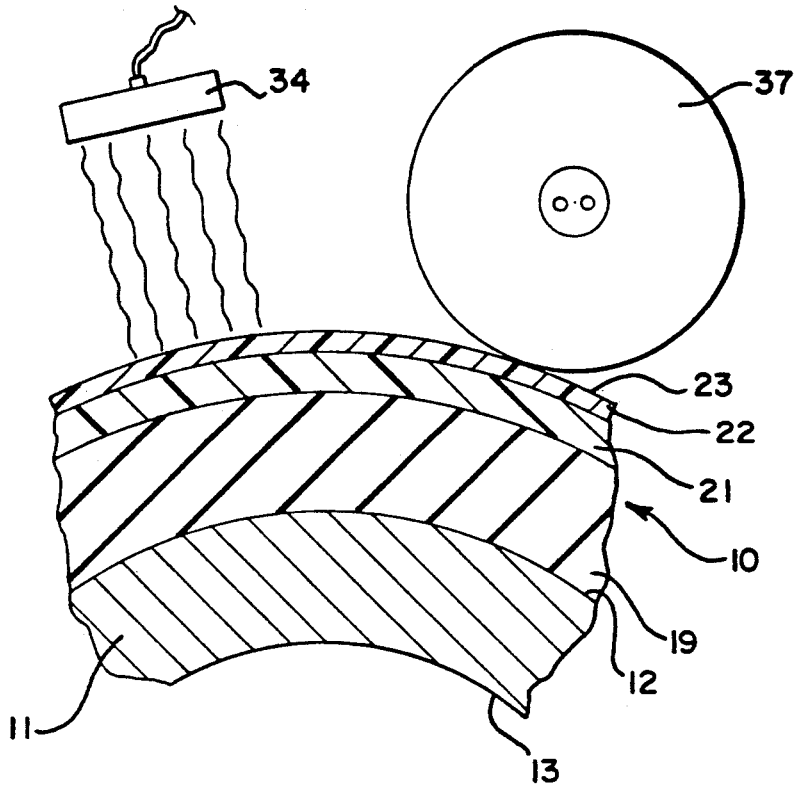
FIG. 2 is a fragmentary vertical sectional view taken through an embodiment of a transfer roller assembly that is suitable for employment both in the apparatus embodiment of FIG. 1 and the apparatus embodiment of FIG. 3, FIG. 2 further including diagrammatic representations illustrating two different roller surface heating means.

One illustrative transfer roller suitable for use in this invention is shown fragmentarily in FIG. 2, such roller being herein designated in its entirety by the numeral 10. Roller 10 incorporates a steel sleeve 11, having an outer cylindrical surface 12 and an interior cylindrical surface 13. Opposite ends 14 of sleeve 11 (see FIG. 3) are each provided with a cap plug 16 that is secured to its respective end 14 by any convenient means, such as by peripheral threads (not shown) about each plug 16 that engage threads (not shown) formed in surface 13 adjacent each end 14, or the like. Each plug 16 is provided with an axial bearing (not shown) which is functionally associated with a stub shaft 18 that outwardly projects from each plug 16. Thus, sleeve 11 is rotatable relative to the stub shaft pair 18.

Outside surface 12 is coated with, and bonded to, a layer 19 of a polyurethane elastomer fluoroelastomer, or the like, which layer 19 preferably ranges in radial thickness from about 2 to about 6 millimeters and which has a Shore A durometer hardness in the range of about 40 to 60. More preferably, layer 19 has a thickness in the range of about 3 to about 5 millimeters and a Shore A durometer hardness of about 50.

Layer 19 is in turn coated with an adherent layer 21 of a polyimide resin such as a "Kaptonv" polymer available commercially from E. I. duPont de Nemours and Co., or the like. A suitable polyurethane elastomer is also shown in U.S. Pat. No. 4,762,941. A present preference is for layer 21 to have a thickness in the range of about 0.5 to about 2 mils and more preferably in about 1 mil.

Layer 21 is, in turn, overcoated with a layer 22 comprised of silicon elastomer, such as "Silastic J TM" available from E. I duPont de Nemours & Co. The function of the layer 22 is to provide an outer surface 23 that has a low surface energy and from which sintered toner powder is easily releasable in accordance with the practice of this invention. The surface energy of surface 23 of roller 10 is preferably about 19 dynes per centimeter.

The structure of roller 10 is suitable for use either in apparatus embodiment 26, or in apparatus embodiment 31.

To enhance the transfer of the toner particles from the transfer roll surface to the receiver surface, a release agent can be used on the surface of the transfer roll. Care should be exercised in the selection of the release agent used on the transfer roll such that the release agent selected will not in any way interfere with or prevent transfer of the toner particles on the surface of the element to the surface of the transfer roll. Alternatively, the receiver can be coated with a thermoplastic polymer as disclosed and described above to enhance toner transfer to the receiver from the transfer roll and, if desired or deemed necessary, a release agent can be applied to the surface of the transfer roll. Caution should be exercised in the selection of a suitable release agent for use on the transfer roll such that the release agent selected not only will enhance or insure toner transfer from the transfer roll surface to the receiver surface but, in addition, will not in any manner adversely effect, interfere with or prevent the adherence of the toner particles to the receiver surface after the toner particles have been transferred from the transfer roll to the receiver surface.

In addition to enhancing toner transfer from the transfer roll to the receiver, when the receiver utilized in the practice of the present invention is a thermoplastic polymer coated receiver, it may be advantageous to apply a release agent to the surface of the transfer roll, the thermoplastic polymer coating on the receiver or both to insure separation of the receiver from the transfer roll after toner transfer. Care should be exercised in the selection of release agents, however, for use on the transfer roll and the receiver such that the release agents selected will not interfere with or prevent the transfer of the toner particles from the surface of the element to the surface of the transfer roll and will not interfere with or prevent adherence of the toner particles to the transfer roll surface after toner transfer from the element to the transfer roll and, in addition, will not interfere with or prevent the transfer of the toner particles on the surface of the transfer roll to the thermoplastic polymer coated receiver or interfere with or prevent the adherence of the toner particles to the thermoplastic polymer coating after transfer of the particles from the transfer roll surface to the thermoplastic polymer coated receiver.

A suitable release agent should stay on or near the surface of the thermoplastic receiver coating and should not penetrate into the thermoplastic coating in significant concentrations or weaken the bonding of the thermoplastic coating to the support. However, the release agent should not be chemically reactive with the thermoplastic in as much as release agents that are chemically reactive with the thermoplastic do not work well.

Examples of suitable release agents for use in this invention include nonpolar compounds, such as hydrophobic metal salts of organic fatty acids, for instance, zinc stearate, nickel stearate, zinc palmitate, and the like; polysiloxanes, including siloxane copolymers, such as poly[4,4'-isopropylidenediphenylene-co-block-poly(-dimethylisiloxanediol)sebacate], and the like; fluorinated hydrocarbons; perfluorinated polyolefins; semicrystalline polymers, such as certain polyethylenes, polypropylenes, polyesters, and the like. Polysiloxane release agents are presently preferred.

Such a release agent can be applied by various techniques known to the art, such as solvent coating, or rubbing (as when a release agent is being applied as a coating upon an element or the like), mechanical mixing (as when particles are blended with a release agent), or the like.

The surface 23 of roller 10 can be heated by exteriorly applied heat. For example, in the apparatus embodiment 26 shown in FIG. 1, a source 33 of electrically generated infrared heat energy is positioned in associated but radically spaced relationship to a circumferential surface portion 23 of a roller embodiment 10A. The source 33 extends longitudinally along such surface portion. The source 33 can be, for example, a series of infrared energy emitting light bulbs (not shown) positioned functionally within a reflector housing 34, and the housing 34 is maintained in a desired spaced relationship to the roller 10A by means of a pair of supports 36. One such support 36 is located at each opposed longitudinal end of reflector housing 34. One end of each support 36 is secured, by rivets, or other fastening means (not shown) to the reflector housing while the other end of each support 36 is extended over, and journaled about, a different stub shaft 18. Thus, during movement of roller 10A, as hereinafter described, the reflector housing 34 travels in fixed, spaced relationship to roller 10A. As a consequence, the circumferential surface portions of the roller 10A are uniformly and progressively heated as the roller 10A revolves on stub shafts 18. The amount of heat emitted from housing 34 is preferably thermostatically controlled.

In a conventional thermal transfer process, in the apparatus embodiment 31 shown in FIG. 3, and also in FIG. 2, an electrically heated roller assembly 49 is provided that has an axis that is in spaced, parallel relationship to the axis of a roller 10B. The rollers are mounted in a frame (not shown) so that a circumferential surface portion of roller 37 is in a longitudinal contacting relationship with an adjacent circumferential surface portion of roller 10B. Thus, when roller 10B is rotatably driven by a powerhead (not shown), roller 37 revolves and uniformly heats circumferential surface portions 23 of roller 10B. Alternatively, in a thermally assisted transfer process, an oven 320 (shown in FIG. 6) can be utilized to heat the receiver 38 prior to its entering the transfer nip formed by rollers 48 and 10B.

Rollers 10A and 10B can have the same structure as the roller 10 in FIG. 2. However, in the apparatus embodiment 26 shown in FIG. 1, the circumference of roller 10A is selected to be slightly larger than the length of the receiver upon which an image is to be copied. For example, for a paper receiver that is 11 inches long, the circumference of roller 10A should preferably be slightly larger than 11 inches, the additional circumferential distance being conveniently used for centering, aligning, various coding purposes, and the like, while the outside diameter of roller 10A is then a little larger than about 3.5 inches. Hence, with roller 10A, information covering the entire surface of the receiver can be contained in a toned image stored intermediately on the outside circumferential surface 23 thereof. In the apparatus embodiment 31 shown in FIG. 3, the circumference of roller 10B does not need to be as large as the circumference of roller 10A of embodiment 26 for a receiver 38 of the same length for the reason that a transferred toned image on the circumferential surface 23 of roller 10B that is removed from the surface of the photoconductor belt element 32 may be removed from surface 23 by being transferred from surface 23 to the surface of receiver 38 before an entire toned image on element 32 has been transferred to surface 23 as will be further appreciated from the additional description regarding embodiment 31 hereinbelow provided.

The apparatus embodiment 26 is adapted for use in copying graphic originals so as to produce copies of very high resolution and fidelity using toner particles that have very small particle size.

In apparatus embodiment 26, a platen 29 is employed that is in the form of a flat plate as illustrated in side elevation in its entirety in FIG. 1, Stage E. Platen 29 is associated with a supporting frame (not shown) that permits the platen 29 to be slidably shifted horizontally back and forth between two positions, a first position as shown in Stage E which is identified as Position I and a second position that is identified herein as Position II. Platen 29 has its upper flat surface functionally divided into two approximately equally sized work areas; each shown in Stage E, the left hand surface area is identified as area 53 and the right hand surface area is identified as area 54. In the embodiment shown, area 53 has a slightly larger size than area 54 to provide a rest or start region for positioning and aligning roller 10A relative to platen 29. When platen 29 is shifted horizontally to the left, the right hand edge 56 of platen 29 is moved to the location formerly occupied by the edge 57 of area 53 so that area 54 then occupies the space formerly occupied by area 53 when platen 29 is in Position II. Translational movements of platen 29 between Position I and Position II can be accomplished either by a motor drive (which can be automated, if desired), or manually (that is desired for purposes of achieving a simple and low cost apparatus embodiment for the practice of the present invention).

In FIG. 1, Stages A, B, and C, only area 53 of platen 29 is shown and platen 29 is in Position I. In Stages A and E, roller 10A is shown in a rest position where preferably a small spacing (not shown) exists between the circumferential surface of roller 10A and the adjacent flat surface of platen 29. Such spacing is desirable to avoid any possibility of producing a flattened region on the circumferential surface of roller 10A. On the surface of platen 29 in area 53, the element 27 is positioned.

Preliminarily (not shown), the photoconductor element 27 is dark adapted and charged in area 53 (conventional). Then, and as shown in Stage A, the surface 1 photoconductor element 27 is latently imaged with a graphic original or the like which is positioned in light frame 58 and whose image is focused on element 27 though a lens 59.

The frame 58 and associated lens 59 are associated with a pivotally mounted turret (not detailed). After the latent image formation procedure is completed, the turret is rotated through 180 about an axis that can be considered for present descriptive purposes to lie in the plane of the paper comprising FIG. 1. Such rotation results in the positioning of a toner development station array, that is designated in its entirety by the numeral 41, at a functional location over the surface of element 27. The development station array 41 is conveniently electrostatic in operation and can be conventionally structured. The rotation of the turret can be accomplished either by a motor drive (which can be automated, if desired), or manually (which is desired for purposes of achieving a simple and low cost apparatus embodiment for the practice of the present invention). The equipment configuration is as shown in Stage B, FIG. 1. After the latent image is developed into a desired visible toned image 61 comprised of toner powder deposited on the latently imaged surface of element 27, the toner powder development is ceased, and the turret is rotated 90° into a neutral configuration relative to the surface of element 27 wherein the development station array 41 and the imaging assembly comprised of frame 58 and lens means 59 are elevated away from element 27.

Then, the subassembly comprised of roller 10A, associated source 33 of infrared energy, and a motor drive arrangement (not detailed) for rotating roller 10A is activated. Thus, the source of infrared energy is activated so that the circumferential surfaces of roller 10A are heated to a predetermined and regulated extent before they move over the area 53 of platen 29 and the element 27 (with the developed image 61 thereon). The roller 10A is applied at a predetermined compressive pressure against the area 53 of platen 29 and the element 27 (with the developed image thereon). The roller 10A rolls over the area 53 of platen 29 and the element 27 (with the developed image thereon) at a predetermined and constant speed. Supporting frame and guidance members are not detailed. After the traverse of roller 10A across area 53 and element 27 is completed, and roller 10A is adjacent the edge 57 of area 53, the equipment configuration is as shown in Stage C of FIG. 1.

As roller 10A traverses element 27 on platen 29 in the direction indicated by the arrow 64, the developed image 61 is transferred from the surface of element 27 to the circumferential surface of roller 10A, and sintering of the toner powder of the image 61 occurs. When roller 10A reaches the region of edge 57, the motor drive is deactuated, and the subassembly of roller 10A, infrared energy source 33 and drive components are elevated to a rest position spaced a short distance away from the surface of platen 29, and platen 29 is translated from Position I to Position II so that now area 54 occupies the space previously held by area 53. Then, the subassembly of roller 10A, source 33 and drive components is lowered to the surface of platen 29, and the motor drive is actuated with the direction of rotation being reversed. Roller 10A thus rolls across a receiver such as a sheet of graphic arts paper 62, positioned in area 54 of platen 29. Before platen 29 is shifted from Position I to Position II, the surface of the sheet 62 is exposed, as shown in Stage E, to infrared radiation from a lamp source 63 that heats this surface to a predetermined and controlled extent. The heating is preferably sufficient for a small temperature drop in surface temperature to occur during translation of platen 29 before roller 10A commences its roll across the surface of sheet 62.

The interrelationship between applied pressure, temperature, and traverse speed of roller 10A is such that the developed image 61 on roller 10A is transferred to the surface of sheet 62. At the end of the traverse of roller 10A across platen 29 in the direction indicated by the arrow 66, the equipment configuration is as shown in Stage D (except that the area 53 of platen 29 is broken away for present illustration purposes). In this configuration, the roller 10A is again elevated to its starting, or rest position (described above) and the platen 29 is moved from Position II back to Position I to achieve the equipment configuration shown in Stage E. If complete heat fusion of the transferred image 61 on sheet 62 did not occur during traverse of roller 10A thereacross, complete heat fusion can be achieved by applying additional energy from lamp 63 to sheet 62.

By providing the turret with three or four development station arrays, each one with a separate toner having a different primary color or black, colored copies can be made with apparatus 26. Thus, three or four successive color separation latent images can be achieved in Stage A, then developed in Stage B and finally transferred to circumferential surface portions of roller 10A in Stage C, so that the colors are successively transferred on top of one another or in register upon circumferential surface portions of the roller 10A. Thereafter, the composite colored image is transferred to a receiver as accomplished in Stage D.

The apparatus embodiment 31 shown in FIG. 3 is adapted for use in producing prints of information generated by a computer and fed as signals to a printhead.

In the apparatus embodiment 31, an LED printhead 39 or the like forms by continuous line scanning a latent electrostatic image on the surface of charged photoconductor belt element 32 as belt element 32 is being continuously advanced by a functionally associated powerhead (not shown). As the belt element 32 baring such latent image moves in spaced relationship past a series of toner powder development stations 41, toner powder is deposited on charged photoconductor belt element 32 and the latent image is sequentially developed into a visible image 42 on the surface of belt element 32.

Concurrently, the roller 37 heats circumferential surfaces (not shown) of transfer roller 10B. As roller 10B rotates, its heated circumferential surfaces are applied with pressure against outside surface portions (not shown) of belt element 32 whereon toned images, such as image 42, are formed. When toned image 42 reaches the nip region 43 formed between roller 10B and belt element 32, the toned image 42 is transferred from such outside surface portions of belt 32 to such circumferential surface portions of roller 10B.

The applied heat and pressure are sufficient to sinter the toner particles comprising the toned image to each other and to adjacent circumferential surface portions of the roller 10B.

Also concurrently, a receiver 38, that is comprised of paper or the like is fed into apparatus 31 and passes through a nip region 44 existing between a receiver sheet front surface, heating roller 46 and backing roller 47, the latter being unheated. In nip region 44, the front face of sheet 38 is heated. Rollers 46 and 47 rotate together with roller 47 moving clockwise and roller 46 moving counterclockwise. As receiver sheet 38 continues to advance, it enters and passes through a nip region 48 existing between roller 10B and backing roller 49, the longitudinally extending contacting surface portions of roller 10B being applied uniformly against adjacent contacting surface portions of roller 49 with pressure. Roller 49 is unheated.

When circumferential surface portions of rotating roller 10B bearing the toned image 42 reach the front surface of receiver sheet 38 in nip region 48, the toned image 42 is transferred from the circumferential surface portions of roller 10B to the front surface of receiver sheet 38. During such transfer, the applied heat and pressure may be sufficient to heat fuse the toner powder comprising the toned image 42 to the receiver sheet 38. The sheet 38 continues to travel and exits apparatus 31.

The belt element 32 continues to move, and when the surface region thereof which supported the toned image 42 reaches cleaning brush 51, this surface region is brushed free of any residual toner powder remaining thereon after the transfer to roller 10B. As belt element 32 continues to move, the brushed surface region travels past charger 52 at which location the belt element is recharged and made ready for a new latent image formation at printhead 39.

Figure 4:
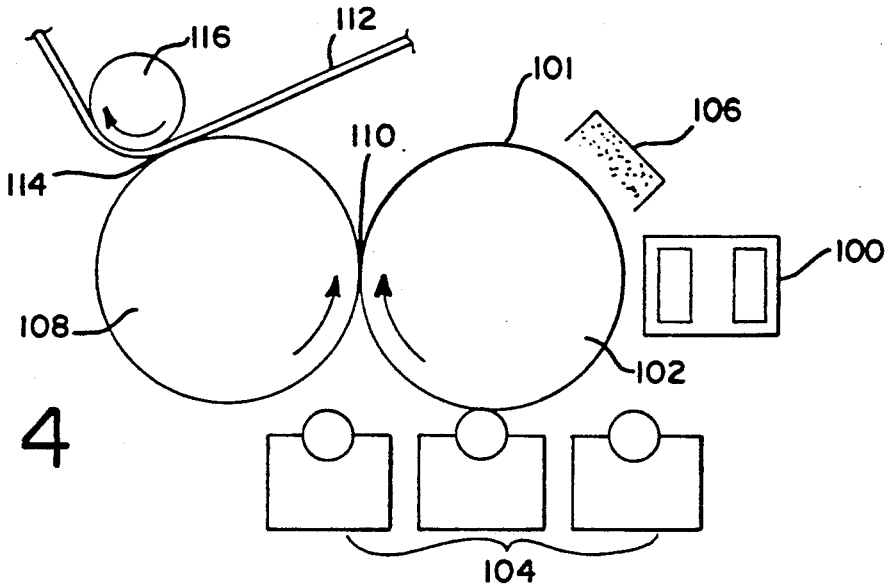
FIG. 4 is a diagrammatic representation of an alternate embodiment of the apparatus in FIG. 3 utilizing a single developing roller and a heated backing roller to heat the receiver sheet.

In the apparatus embodiment depicted in FIG. 4, an LED printhead 100 or the like forms, by continuous line scanning, a latent electrostatic image on the surface of a charged photoconductor element (not pictured) carried on the surface 101 of developing roller 102. As the element bearing the latent image moves in a spaced relationship past a series of toner powder development stations 104, toner powder is deposited on the photoconductor element which was previously charged by electrocharger 106, and the latent image is sequentially developed into a toned, visible image (not shown) on the photoconductor element.

Heated transfer roller 108 rotates in the opposite direction of roller 102. As roller 108 rotates, its heated circumferential surface is applied with pressure against outside surface portions (not shown) of the photoconductor element on roller 102 with a toned image thereon. When the toned image reaches the nip region 110 formed between roller 108 and the photoconductor element on the surface 101 of roller 102, the toned image is transferred from the photoconductor element on the surface 101 of roller 102 to the surface of roller 108.

The applied heat and pressure may be sufficient to sinter the toner particles comprising the toned image to each other and to adjacent circumferential surface portions of roller 108.

Concurrently, a receiver sheet 112, that is comprised of paper or the like passes through a nip region 114 existing between the heating roller 108 and backing roller 116. The backing roller 116 is heated and the contacting surfaces of roller 108 are applied with pressure against the contacting surfaces of backing roller 116.

When circumferential surface portions of roller 108 bearing the toned image reach the front surface of receiver sheet 112 in the nip region 114, the toned image is transferred from the surface portions of roller 108 to the front surface of receiver sheet 112. The applied heat and pressure by rollers 108 and 116, again, may be sufficient to heat fuse the toner powder comprising the toned image to the receiver sheet 112.

Figure 5:
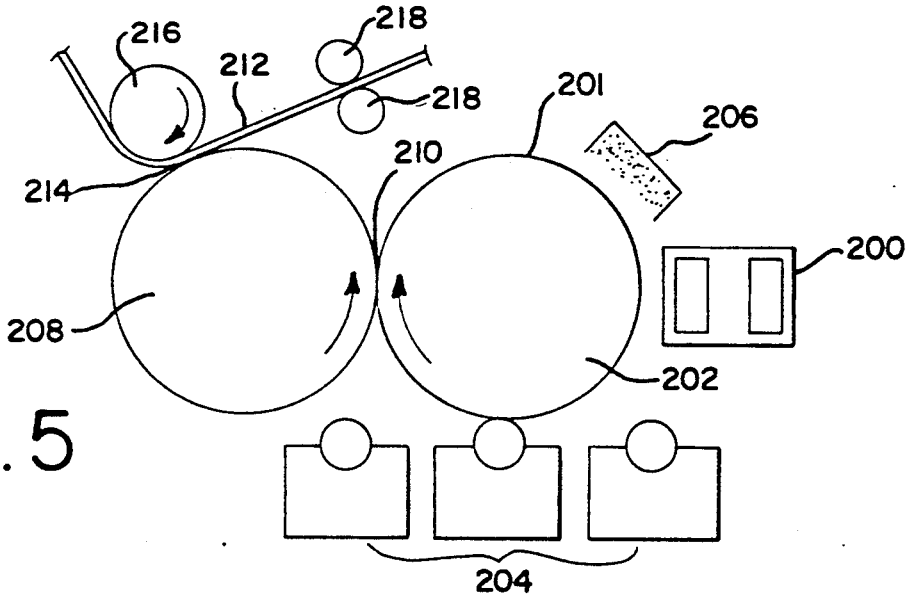
FIG. 5 is a diagrammatic representation of the embodiment depicted in FIG. 4 in which the receiver sheet bearing the transferred image passed through a fuser element.

Referring to FIG. 5, the apparatus depicted therein is similar to that of FIG. 4. A single roller 202 with a toned image (not shown) developed on a photoconductor element (not shown) on the surface 201 as described above contacts a heated transfer roller 208 under pressure, transferring the toned image thereto. A receiver sheet 212 passes through a nip region 214 between the heated transfer roller and a backing roller 216. The image is transferred from the heated transfer roller 208 to the receiver sheet 212 at nip region 214. Sufficient pressure and heat is provided by backing roller 216 and transfer roller 208 to transfer the image to the receiver sheet 212. After the image has been transferred to receiver sheet 212, the receiver sheet 212 passes through a fuser 218 which heat fuses the toned image onto the receiver sheet 212, which continues to travel and then exits the apparatus.

Figure 6:
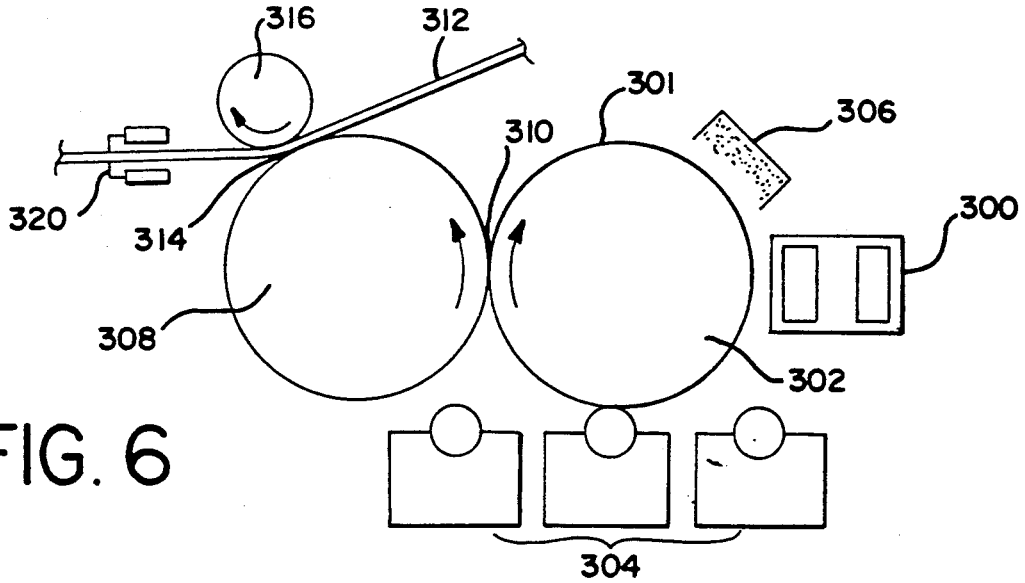
FIG. 6 is a diagrammatic representation of the embodiment depicted in FIG. 4 in which an oven is used to heat the receiver sheet.

Referring to FIG. 6, the apparatus is similar to the apparatus of FIG. 4. A single roller 302 with a toned image (not shown) developed on a photoconductor element (not shown) on the surface 301 as described above contacts a heated transfer roller 308 under pressure, transferring the toned image thereto. A receiver sheet 312 passes through a nip region 314 between the heated transfer roller and a backing roller 316. The image is transferred from the heated transfer roller 308 to the receiver sheet 312 at nip region 314. Before receiver sheet 312 enters nip region 314, it passes through and is heated by receiver oven 320, so that sufficient heat and pressure is applied to receiver sheet 312 to transfer the image from transfer roller 308 to receiver sheet 312. The amount of heat and pressure applied to receiver sheet 312 may be sufficient to heat fuse the toner powder comprising the toned image to the receiver sheet 312. After the receiver sheet 312 passes through nip region 314, it continues to travel and exit from the apparatus.

(d) Process

By the present invention, a toned image is transferred from an element to a receiver sheet.

In a first contacting step, one rolls heated surface portions of an intermediate transfer roll over the surface of the element with the toned image therebetween. The applied pressure is preferably in the range of about 25 to about 125 psi, and more preferably about 50 to about 100 psi in the nip region between the roller and the element. The surface of the roller is heated to a temperature sufficient to sinter the toner particles. The sintering temperature of the toner particles is selected to be below the glass transition temperature of the organic polymeric material comprising the surface of the element. A present preference is to employ a roller surface temperature which is within the range of about 100° to about 160° C. and more preferably is within the range of about 100° to about 120° C., although higher and lower temperatures can be employed, if desired. The linear rolling speed of the circumferential surface portions of the roller in the direction of roll is typically in the range of about 1.3 to about 23 centimeters per second, and preferably in the range of about 5 to about 15 centimeters per second.

The circumferential surface of the roller preferably has a surface energy as above described and preferably has a durometer hardness as above described.

This step is preferably carried out using a combination of conditions that comprises:

a temperature in the range of about 50° to about 120° C.;

a pressure in the range of about 50 to about 100 psi; and a rolling speed in the range of about 5 to about 15 centimeters per second.

Then the image-carrying circumferential surface of the transfer roller is rolled against the surface of a receiver and the image is transferred thereto using elevated temperature, elevated pressure and a controlled rolling rate.

In this step, the temperature is generally in the range of about 100° to about 120° C.;

the pressure is generally in the range of about 50 to 100 psi; and the rolling rate is generally in the range of about 5 to about 15 centimeters per second.

The invention has been described in detail with particular reference to preferred embodiments thereof, but it will be understood that variations and modifications can be effected within the spirit and scope of the invention.

I claim:

1. A process for transferring at least one toned image from a photoconductor element surface to a receiver comprising rolling a heated intermediate transfer roller over the element while the temperature of the circumferential surface portions of the roller is sufficient to sinter the toner particles comprising said toned image to each other; and rolling the heated, toned image bearing roller over the receiver to transfer the tone image to said receiver wherein the temperature of said receiver is at least about equal to the temperature of the roller.

2. The process of claim 1 wherein said toned image is heat fused to said receiver surface.

3. The process of claim 2 wherein said temperature of said receiver surface is sufficient to heat fuse said toned image to said receiver surface.

4. The process of claim 2 wherein said toned image is heat fused after said toned image has been transferred to said receiver.

5. The process of claim 1 wherein said receiver has a thermoplastic polymer coating and the toner particles are transferred from said intermediate roller to said receiver.

6. The process of claim 1 wherein more than one developed or toned image is formed on the photoconductor element surface in succession, each in a different color, and wherein each image is successively or sequentially transferred from the element to the intermediate transfer roll one on top of another or in register after at least one toned image is formed on the element and thereafter transferring the composite toned or color image thus formed from the intermediate transfer roll to the receiver.

7. The process of claim 6 wherein at least three developed images are formed on the element selected from the three primary colors and black.

8. The process of claim 6 wherein said composite toned image is heat fused to said receiver surface.

9. The process of claim 8 wherein said temperature of said receiver surface is sufficient to heat fuse said toned image to said receiver surface.

10. The process of claim 8 wherein said toned image is heat fused after said toned image has been transferred to said receiver.

* * * * *